US006070859A

United States Patent [19]

Damon et al.

[11] Patent Number: 6,070,859

[45] Date of Patent: Jun. 6, 2000

[54] GAP BLOCKER AND VEGETATION BARRIER FOR THE BOTTOM OF FENCES

[76] Inventors: Gary L. Damon, 2150 N. Raymond Rd., Dewar, Iowa 50623; Robert J. Connell, 1111 Maxine Ave.; Jerry L. O'Donnell, 3906 Onawa Dr., both of Waterloo, Iowa 50701

[21] Appl. No.: 08/942,750

[22] Filed: Oct. 2, 1997

[51] Int. Cl.[7] ..... E04H 17/00

[52] U.S. Cl. ..... 256/1; 256/32; 47/33; 47/25

[58] Field of Search ..... 256/1, 32, 33; 47/33, 25, 84

[56] References Cited

U.S. PATENT DOCUMENTS

| | | | |
|---|---|---|---|
| 2,826,393 | 3/1958 | Miller . | |
| 3,515,373 | 6/1970 | Abbe . | |
| 3,619,944 | 11/1971 | Matvey | 47/33 |
| 3,704,004 | 11/1972 | Carter, Jr. | 256/1 |
| 3,713,624 | 1/1973 | Niemann . | |
| 3,806,096 | 4/1974 | Eccleston et al. . | |
| 3,991,980 | 11/1976 | Blackburn | 256/1 |
| 4,349,989 | 9/1982 | Snider, Jr. . | |
| 4,497,472 | 2/1985 | Johnson . | |
| 4,903,947 | 2/1990 | Groves | 256/32 |
| 4,907,783 | 3/1990 | Fisk et al. . | |
| 4,964,619 | 10/1990 | Glidden, Jr. . | |
| 5,039,065 | 8/1991 | Denton | 256/1 |
| 5,178,369 | 1/1993 | Syx . | |
| 5,285,594 | 2/1994 | Penny . | |
| 5,328,156 | 7/1994 | Hoke . | |
| 5,522,176 | 6/1996 | Suttle | 47/25 |

*Primary Examiner*—Lynne H. Browne
*Assistant Examiner*—David E. Bochna
*Attorney, Agent, or Firm*—Zarley, McKee, Thomte, Voorhees & Sease

[57] ABSTRACT

An improved blocking member and vegetation barrier for the bottom of fences includes a riser portion that runs along one side of the fence. The riser is somewhat flexible and is securable to the fence in a manner that allows the installer to adjust the riser vertically relative to the fence or other portions of the riser, if necessary, and restrain it from any substantial vertical movement once secured. A ground covering member extends transversely from the lower part of the riser. Thus, the ground covering member can be placed directly on the ground even if the ground undulates relative to the fence bottom, and can be kept in that position once the riser is secured to the fence. The ground covering member can be resilient and create reactionary force if it is pressed against the ground. This can further assist in maintaining the blocking member and vegetation barrier in a fixed position relative the ground and the fence. The device can be made in lengths that can be interconnected by spacers that extend between the lengths.

32 Claims, 7 Drawing Sheets

GAP BLOCKER AND VEGETATION BARRIER FOR THE BOTTOM OF FENCES

BACKGROUND OF THE INVENTION

1. Field of the Invention

The present invention relates to fences, particularly those used for residential purposes, and in particular, to devices and methods to deter vegetation growth under the fences.

2. Problems in the Art

Property owners many times erect fences to delineate property boundaries, to obtain privacy, or to restrict either access to or egress out of the property at that location. The most popular types of fences, particular for residential properties, are chain link fences and wooden board fences.

Both types generally include fence posts secured in the ground at regularly spaced intervals. The fence itself is usually built between posts and above the ground. It is usually intended and desired that the bottom of the fence extend to the ground or as close to the ground as possible to provide a barrier to entry or exit of even smaller animals or pets.

Several problems face the fence owner. First, when installing the fence there are limitations as to how close to the ground the fence can be placed, especially if there are changes in the contour of the ground along the fence. Chain length fencing has some ability to follow such contours, but if the fence is to be held tight between posts, such flexibility is limited. Wooden fences can be customized as to each board's length, and thus theoretically could adapt to any contour. However, realistically, most fences come premanufactured with boards of the same length. It is usually desired to have the top of the fence relatively uniform, and therefore, varying the height of several boards to meet a depression or raised portion of the ground is not desirable.

Secondly, trimming grass and weeds and other vegetation around the fence bottom can be difficult and time consuming. While labor-reducing devices such as string trimmers are in wide use, it is still time consuming to trim along fences, and most fences tend to wear away the string of such trimmers at a substantial rate.

Thus there is a need for a solution to the problems of building a fence only to have gaps between portions of the fence bottom and the ground, especially where there are undulations or changes in the contour of the ground along the fence, especially between fence posts, and of building a fence and facing the task of keeping it free from vegetation or having an unsightly fence row.

Somewhat surprisingly, there are a significant number of issued patents that address the issue of providing a barrier to vegetation along a fence bottom. Examples can be found at:

| PATENT NUMBER | ISSUE DATE | PATENTEE |
|---|---|---|
| 2,826,398 | 3/11/58 | MILLER |
| 3,515,873 | 6/02/70 | ABBE |
| 3,713,624 | 1/30/73 | NIEMANN |
| 3,806,096 | 4/23/74 | ECCLESTON ET AL. |
| 4,349,989 | 9/21/82 | SNIDER, JR. |
| 4,497,472 | 02/05/85 | JOHNSON |
| 5,178,369 | 01/12/93 | SYX |
| 4,907,783 | 3/13/90 | FISK ET AL |
| 4,964,619 | 10/23/90 | GLIDDEN, JR. |

-continued

| PATENT NUMBER | ISSUE DATE | PATENTEE |
|---|---|---|
| 5,285,594 | 2/15/94 | PENNY |
| 5,328,156 | 7/12/94 | HOKE |

However, none of these patents address satisfactorily the first problem discussed above; namely, how to block gaps that exist or form between the bottom of a fence and the ground. Patents such as Abbe are buried in the ground, and therefore follow the ground contour, but have no upwardly extending portion. Therefore, big gaps would remain. Others are too structurally rigid to bend, once installed, or do not have anyway to bend to follow a ground contour.

Moreover, many of the patents are complex, expensive to make or install, or otherwise have deficiencies that could allow improvement. A subtle deficiency in some prior art attempts is that part of the installation would have to occur on the adjoining property owner's land, which sometimes is not possible or will not be permitted.

Therefore, despite a seemingly substantial number of attempts at solving the problems with the bottoms of fences, a real need in the art has been identified. It is therefore a principle object of the present invention to overcome the problems and deficiencies in the art.

Still further objects of the present invention are to provide an improved gap blocker and vegetation barrier for fence bottoms which:

1. can be conformed to a wide variety of ground contours and fence bottoms while maintaining both functions of blocking any gaps and deterring vegetation growth.
2. is strong and durable, even when stepped by persons or animals and run over by mowers.
3. is easy to install.
4. is economical.
5. is flexibly adaptable regarding type of fence, type of barrier desired, coverage of barrier desired, size and length of fencing, number of corners of fencing, and other characteristics of fences, ground and environment.
6. can be retrofitted to existing fences of many different types or installed with the installation of a new fence.
7. is effective to block gaps and deter vegetation growth at the bottom of fences.
8. is aesthetically pleasing.

These and other objects, features, and advantages of the present invention will become more apparent with reference to the accompanying specification and claims.

SUMMARY OF THE INVENTION

The present invention is a gap blocker and vegetation barrier for the space between a fence bottom and the ground. It comprises an elongated member which includes a vertical riser having securing members that allow it to be secured to the fence in a manner that the riser can be kept relatively stationary from vertical movement. A ground cover portion extends from the riser generally horizontally and serves to cover and deter vegetation growth. The ground cover portion can either extend in one direction from the riser so that it covers the ground on only one side of the fence, or can extend in both directions, with one side of the cover portion slideable under the fence and covering a portion of ground on the opposite side of the fence.

The apparatus is made from a material and of a structural characteristic that it can flex along its longitudinal axis to follow a large majority of ground contour changes or undulations. The ability to secure the riser to the fence allows the apparatus to be drawn up or pushed down relative to different locations along the bottom of the fence to follow a differing contour of the ground, and then secured in place. The riser then extends between the fence and the ground as a blocking member for what otherwise might be gaps between the bottom of the fence and the ground, and the ground cover portion of the apparatus is a barrier against vegetation growth to save the time and effort of having to trim directly under the fence.

DETAILED DESCRIPTION OF THE PREFERRED EMBODIMENT

Figure 1:
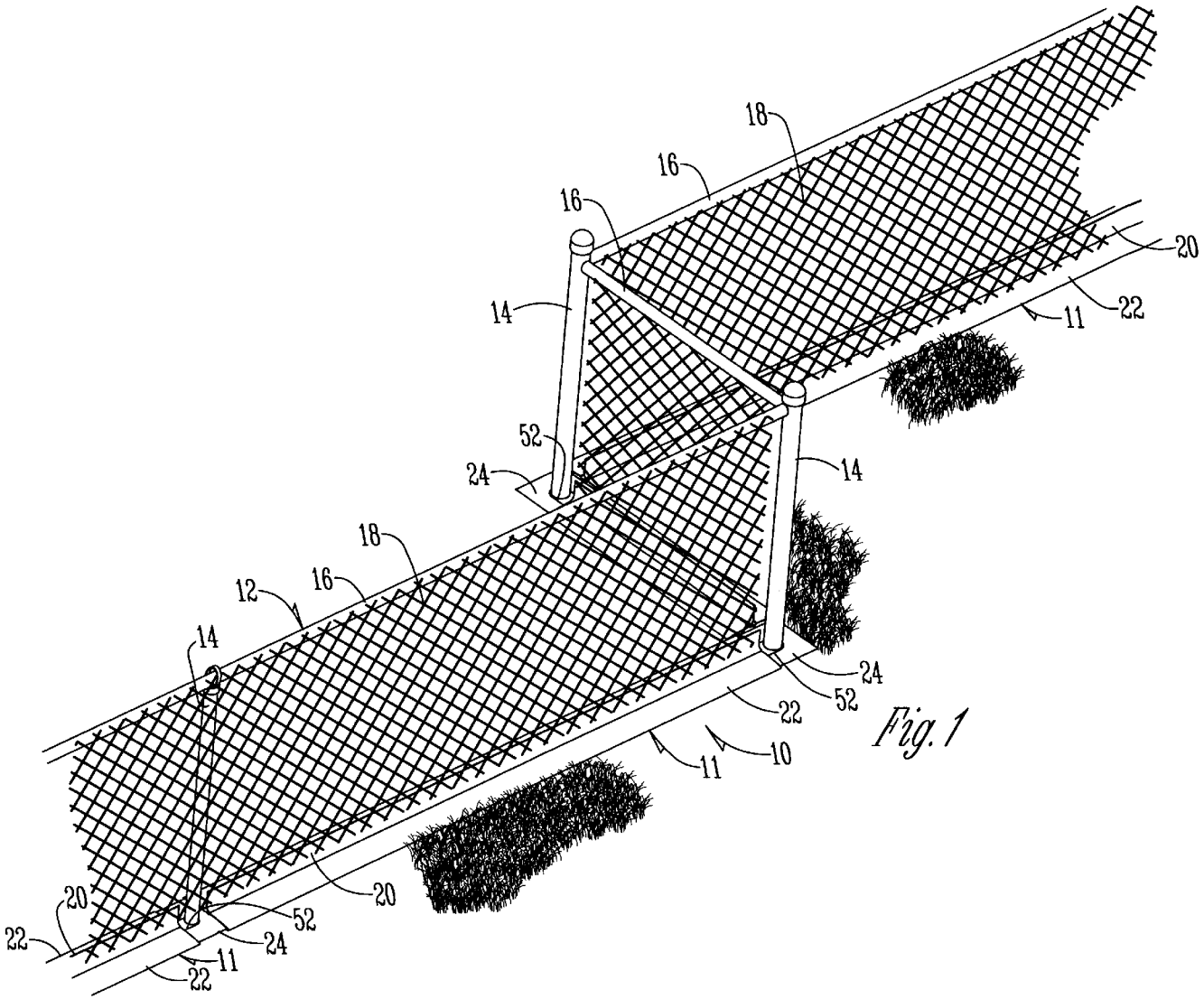
FIG. 1 is a perspective view of a multi-section apparatus according to the present invention installed with respect to a chain link fence.

To assist in a better understanding of the invention, one embodiment the invention can take will now be described in detail. Frequent reference will be taken to the drawings. Reference numbers will be used to indicate certain parts or locations in the drawings. The same reference numerals will be used to indicate the same parts and locations throughout all the drawings unless otherwise stated.

FIG. 1 shows an apparatus according to the present invention which will hereafter be referred to generally as barrier 10 installed in position relative to a chain link fence 12. Fence 12 includes fence posts 14 secured into the ground at spaced apart positions, top rails 16 secured between posts 14, and the chain link fabric or web 18 strung between poles 14. Barrier 10 is positioned under the bottom of web 18 of fence 12 along its entire length. It is to be understood that barrier 10 will be discussed mainly in the context of use with a chain link fences, such as are well known well, but it can be used with other types of fences. Some examples will be discussed later.

Barrier 10 is produced in elongated sections 11, ideally of lengths that span just about the distance between posts 14. For example, if the standard distance between posts 14 was ten feet, each barrier section 11 would be made slightly under ten feet long so that it could be inserted between the posts 14 with a little space left. However, obviously, sections 11 could be made to any length and could have variable length.

Each section 11 of barrier 10 has a riser 20 and ground cover portion 22. As seen in FIG. 1, when installed risers 20 extend generally vertically along one side of web 8 and cover portions 22 extend generally horizontally over the ground below or near the bottom of web 18. Spacers 24 are insertable between sections 11 of barrier 10 to cover the ground between those sections, particularly around fence posts 14.

As can be seen in FIG. 1, barrier 10 not only covers and deters vegetation growth under fence 12 and for a distance to the side of fence 12, but also blocks any gaps between the bottom of web 18 and the ground. It also gives the appearance of a foundation or base which is aesthetically appeasing. It is to be understood that barrier 10 could be made of different colors, including to match the color of the fence or to match the color of vegetation, such a green for grass, to assist in the aesthetic appearance.

Figure 2:
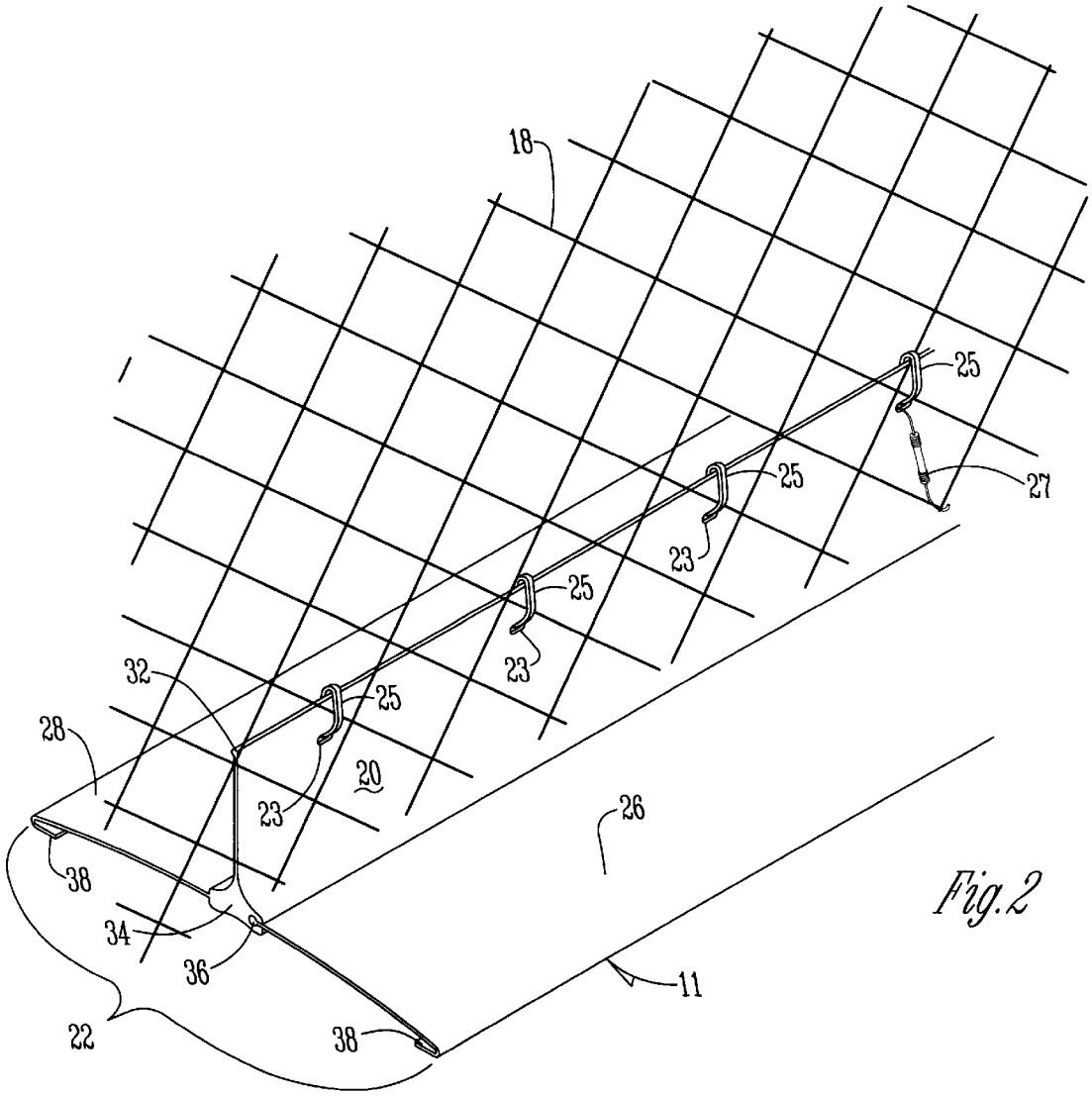
FIG. 2 is an enlarged perspective view of a single section of the apparatus of FIG. 1 relative to a chain link fence.

More detail of the structure and installment of barrier 10 can be seen in FIG. 2. Each riser 20 has a number of apertures 23 along its length, preferably near its top edge (e.g. elongated holes through riser 20 approximately 3/16" to ¼" in dimensions and spaced apart approximately 4" on center). Securing loops 25 are placed through apertures 23 and then around at least one strand of web 18 of fence 12. Generally, not every aperture 23 would have a securing loop 25. For example, perhaps one securing lop would be used every sixth aperture 23 (if apertures 23 were 4" apart), unless securement at other locations was needed or desired. In this embodiment, ground cover portion 22 consists of panels 26 and 28, forming a T-shape cross section for barrier 10. Panel 26 extends under web 18 to the opposite side of fence 12 from the side of riser 20, whereas panel 28 extends away from riser 20 on the same side of the fence as riser 20.

Riser 20 and panels 26 and 28 are made from 1/16" thick plastic, preferably PVC or polyethylene with UV resistance. Such materials can be made to have substantial strength but yet have some flexibility. Note that the top of riser 20 has a bead 32 for strength. The bottom of riser 20 has a thickened portion 34 for strength without unduly limiting the flexibility. Panel 28 is integral with portion 34, whereas in this embodiment, panel 26 is a separate piece that can be mounted to portion 34 by sliding bead 36 of panel 28 longitudinally into and along a channel 42 along the length of riser 20.

Note too that panels 26 and 28 are concave with respect to the ground and have turned under edges 38. This combination allows some resilient springing action of the ground cover portion of barrier 10 relative to riser 20 when barrier is either pressed down (e.g. by persons or animals stepping on or mowers moving over a panel 26 or 28) or when the barrier is intentionally pressed down and secured into place relative to fence 12. This therefore assists in blocking any gaps between the fence bottom and the ground and deterring vegetation growth by securely covering the ground without sunlight.

Securing loops 25 are conventional plastic tie downs available from a wide variety of sources. They have a toothed surface along at least a portion of their length (e.g. 4" long) that is pulled through a piece, and like a ratchet, the loop that is formed can be cinched down (reduced in size)

and maintained in place, and can not move back to a larger size without destroying the tie down. These are well known. They are inexpensive, easy to install, flexible in characteristic and in the length which they can be, and are durable. Other securing loops are possible. One example would be bungy cords (FIG. 2 at 27) or other elastic devices with hooks or other end point securement means. Other types of securing members are also possible.

Figure 3:
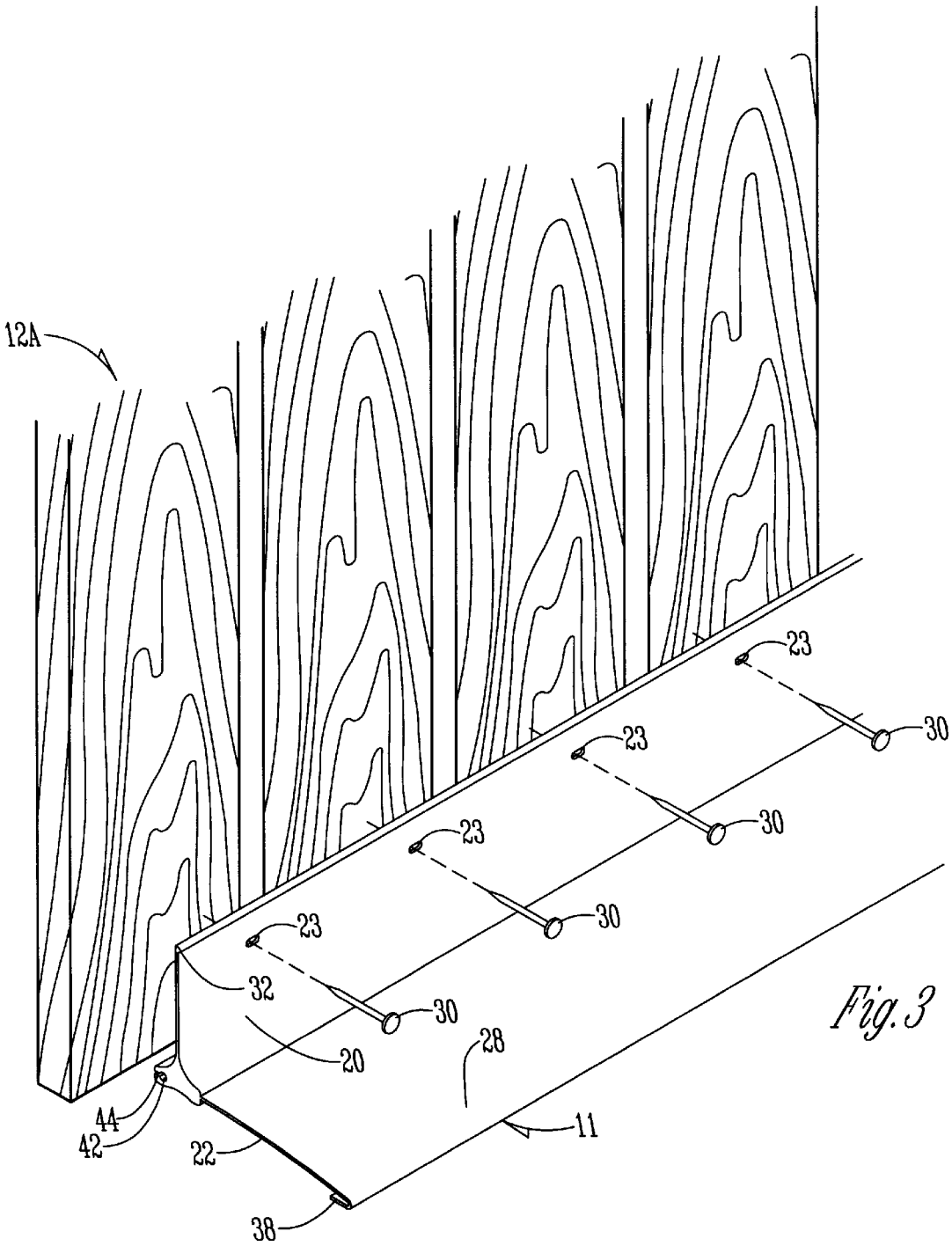
FIG. 3 is an enlarged perspective view of a section of the apparatus according to an alternative embodiment of the present invention installed to a wood fence.
Figure 4:
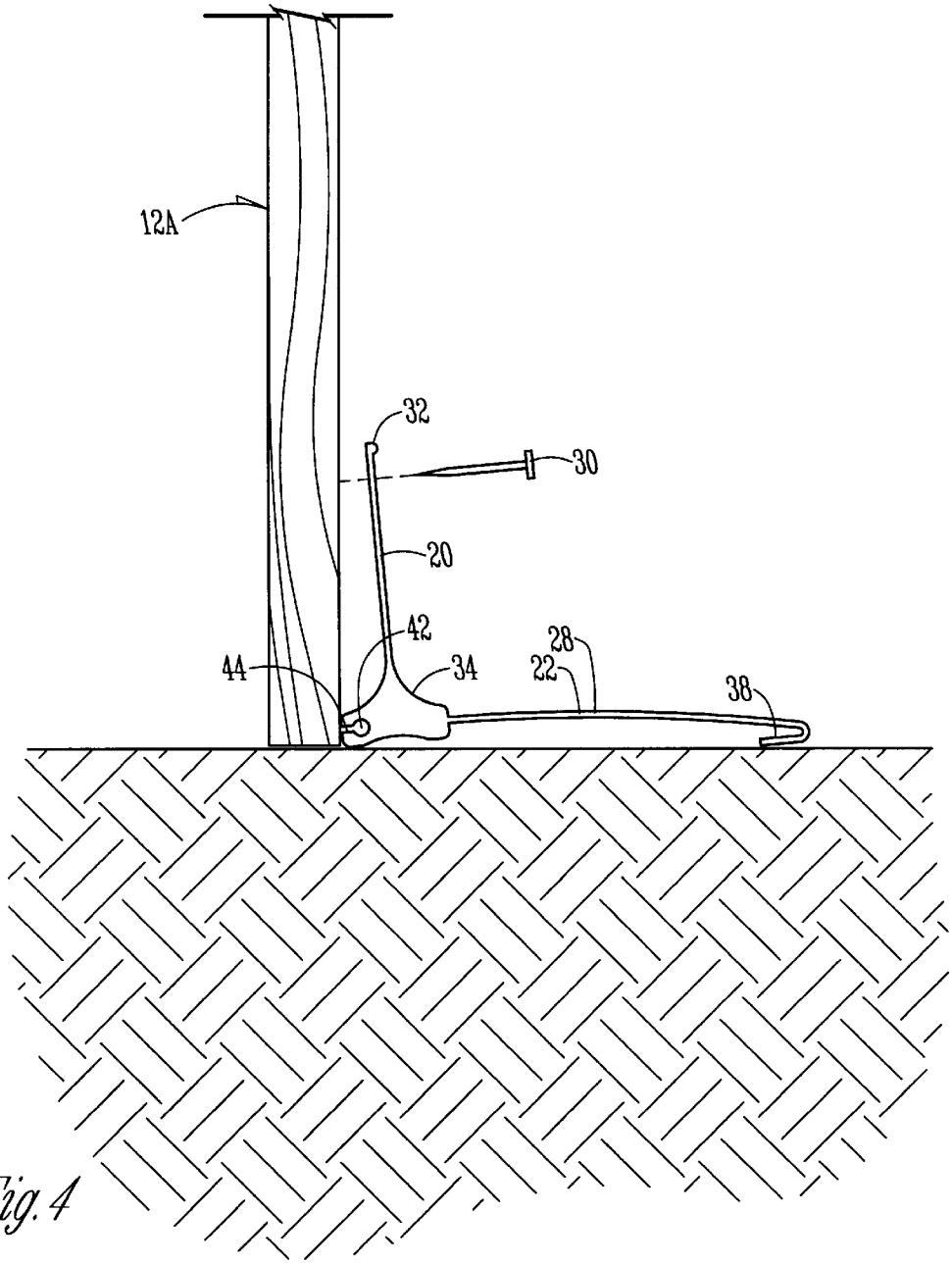
FIG. 4 is an enlarged end elevation view of FIG. 3.
Figure 4A:
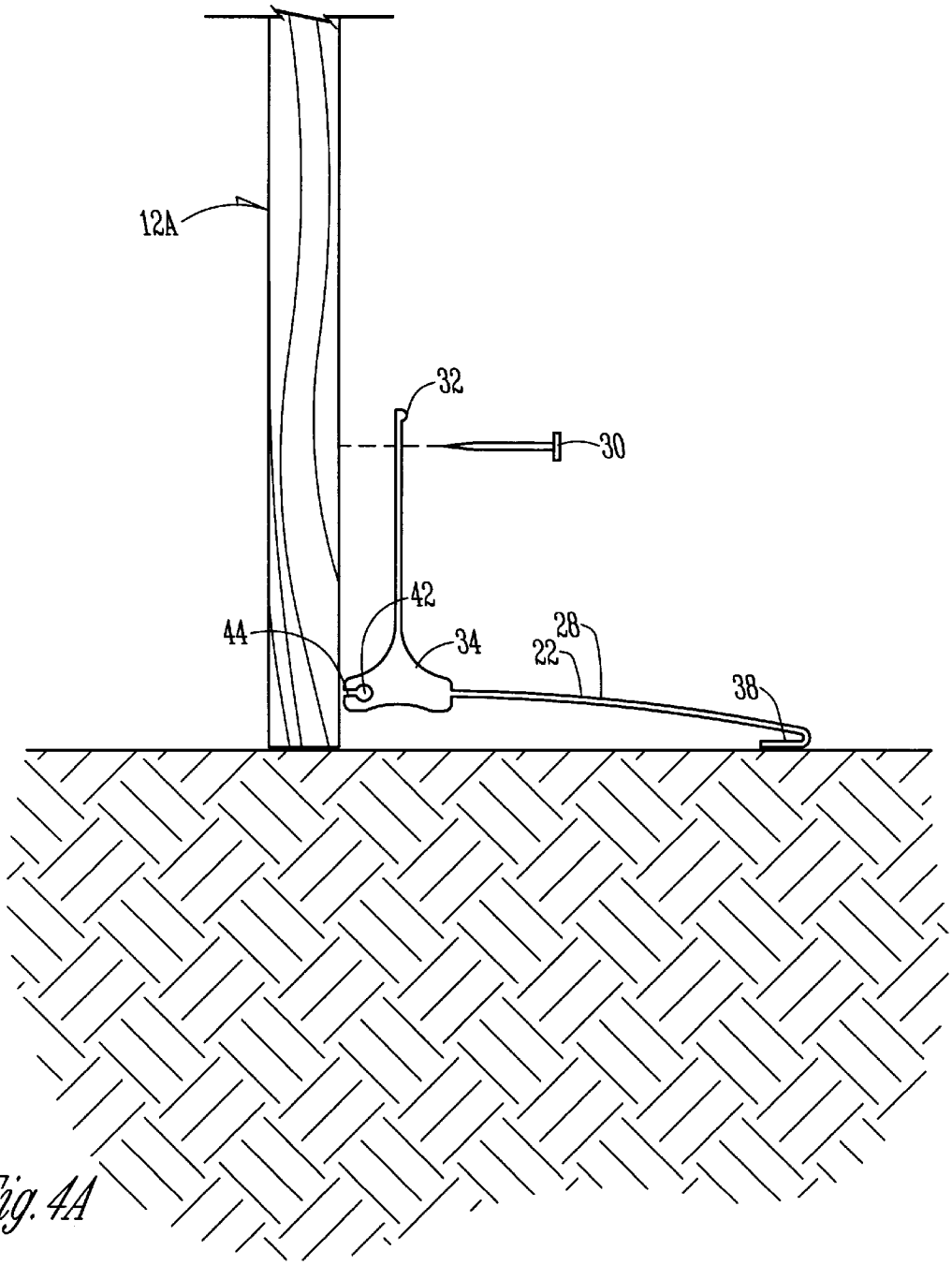
FIG. 4A is similar to FIG. 4 but shows the apparatus according to the preferred embodiment of the present invention blocking a gap between the fence bottom and the ground.

FIG. 3 illustrates how barrier 10 could be used with a wood fence 12A. It is more likely that a wood fence 12A would extend all the way to the ground or that it would not be easy to slide a panel 26 under the fence. Because the opposite side of the fence can not be seen, it may not be desired to utilize panel 26. Therefore, panel 26 can be removed (or never be installed) and, as shown in FIG. 4, riser 20 could be brought up against the wood fence 12A, and wood screws, nails, or other fasteners 30 placed through apertures 23 and into the wood. Barrier 10 would be held securely in position, including against any vertical movement. Thus, even though the fence bottom or top or both are level, for example, barrier 10 could be pushed down or pulled up along its length at various points, and secured in place on the fence. As with the prior example, the flexibility of barrier 10, along with the ability to secure riser 20, would allow barriers 10 to be flexed to follow the contour of the ground, even if the fence did not follow it. Therefore, any gaps could be taken care of by barrier 10. Compare FIGS. 4 and 4A.

Figure 5:
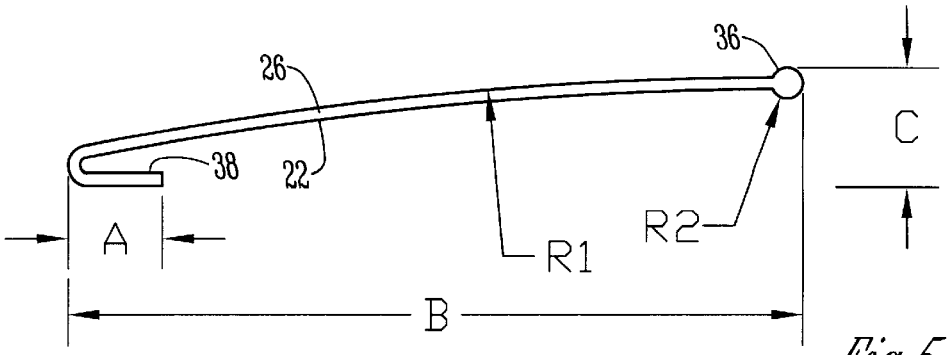
FIG. 5 is a still further enlarged, isolated end elevation view of a removable ground cover section of the apparatus of FIG. 1.

Barrier sections 11 can have the following general approximate dimensions—overall length of ten feet (but trimmable to different lengths); two to three inches tall (the height of riser 20); and six to eight inches wide (the width of both panels 26 and 28). FIG. 5 illustrates removable panel 26 in more detail. The dimensions of panel 26 are: A=0.50",; B=3.38"; C=0.64". Radius R1 is based upon a 14.4" radius; radius R2=0.120"; and radius R3=0.20". Bead 36 of panel 26 fits within a 0.125" diameter round channel 42 along portion 34 of riser 20. Slot 44 extends out form channel 42 to allow passage of panel 26 out of portion 34 and to prevent it from tilting up or down. Similar dimensional relationships exist for panel 28. Bead 32 on riser 20 is approximately ¼" in diameter and extends on one side of riser 20.

Figure 6:
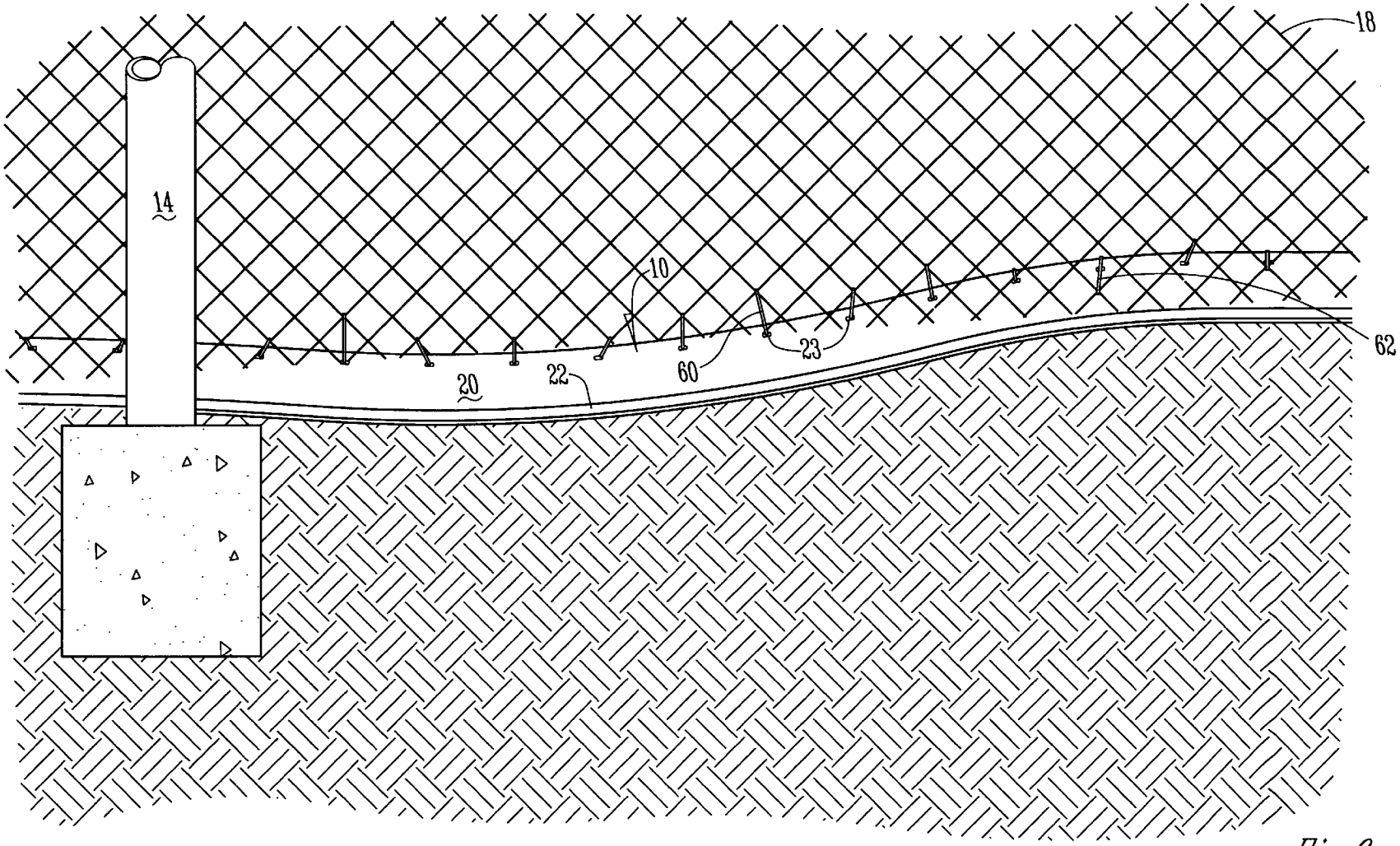
FIG. 6 is a partial sectional, front elevation view illustrating how the apparatus according to the present invention can be installed relative to a fence to follow contours of the ground.

FIG. 6 illustrates how barrier 10 can follow bends in the bottom of fence 10 or changes on contour of the ground. Securing loops 25 can be used to tie riser 20 to varying positions along fence web 18. Therefore, if barrier 10 needs to be drawn down somewhat to follow a depression in the ground or the bottom of fence 10, riser 10 is simply drawn down and tied to web 18 at a lower point than other parts of barrier 10. Plastic ties as securing loops 25 allow the installer some leeway because it may require that the plastic tie reach quite a ways up or down on web 18 to draw barrier 10 to the required position (see reference numbers 60 and 62 and compare how they and where they are tied to fence web 18. The flexibility to flex riser 20 along its length is such that it can bend several inches per linear foot of length.

Figure 7:
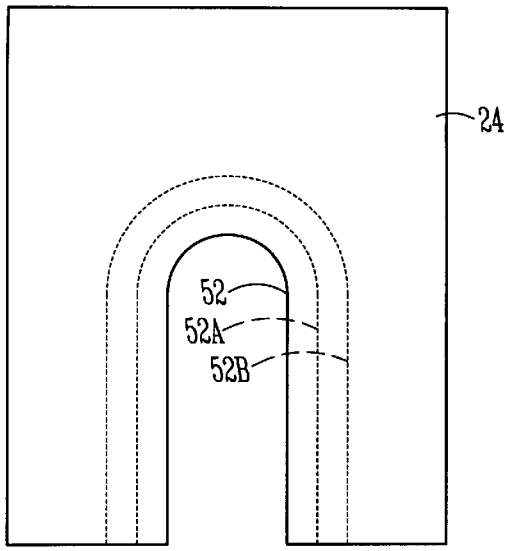
FIG. 7 is a top plan view of an interconnecting member to interconnect sections of the apparatus of FIG. 1 and to interconnect said sections and cover the ground around fence posts.
Figure 8:
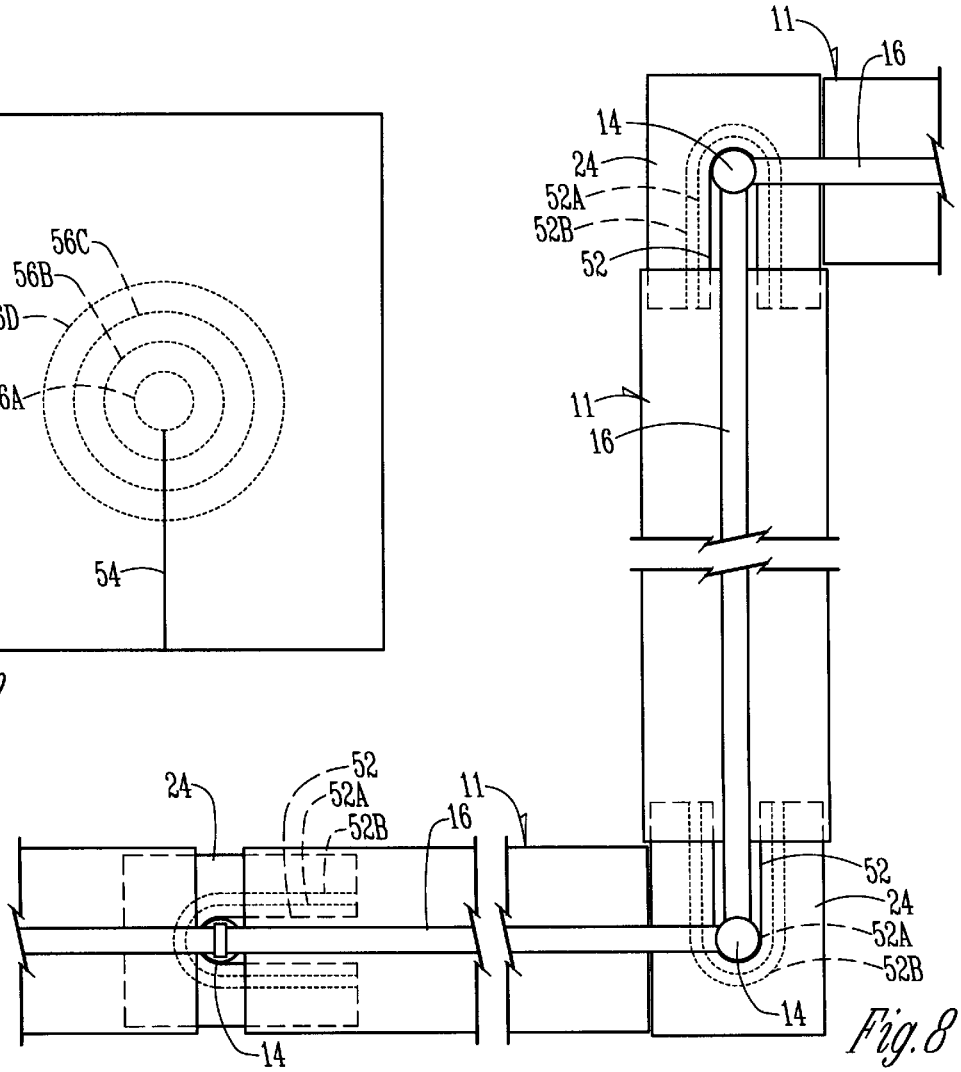
FIG. 8 is a top plan view of the interconnecting member of FIG. 7 installed relative to fence posts and corners in the fence of FIG. 1.

FIGS. 7 and 8 illustrate the spacers 24 that can cover the area around fence posts 14 or simply be used to bridge between two sections 11 of barriers 10. In one form, spacer 24 is a flat square piece of plastic having a cut out 52 sized for insertion around a round fence pole 14. Dashed line 52A indicates that a punch out or cut out line could be manufactured into the spacer to allow easy modification of spacer 24, if needed, for bigger poles.

FIG. 8 shows that spacer 24 would be inserted around pole 14 and then slid into the turned under edges 38 of panels 26 and 28 on one side of post 4. The other barrier section 11 would simply be brought near or into abutment with spacer 24 and secured into position. All areas under fence web 18 would then be at least substantially covered. Spacer 24 is sized so that its width slides into and is captured in turned down edges 38 of panels 26 and 28 of ground cover portion 22. It can be approximately 6" to 8" width and can be approximately 10" long and 1/16" thick.

Figure 9:
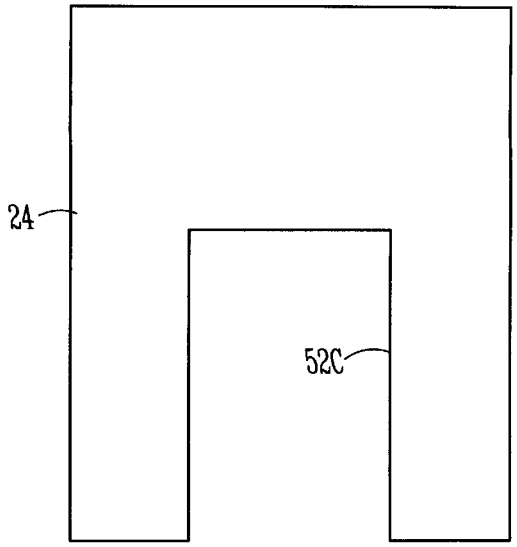
FIGS. 9 and 10 are top plan views of optional interconnecting members to that of FIG. 7.
Figure 10:
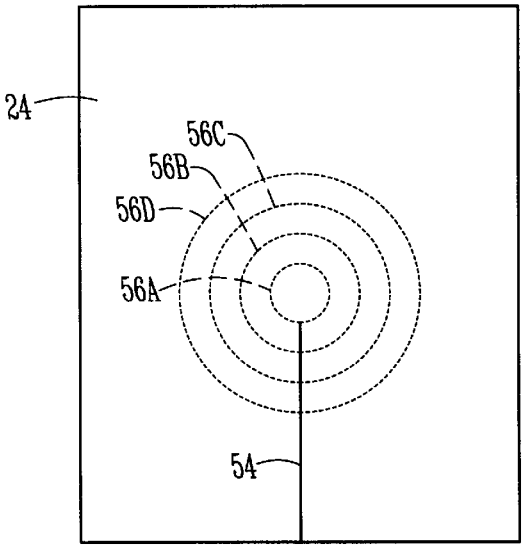

FIG. 9 illustrates that alternatively, cut out 52C could be square to accommodate square fence posts, such as some wood posts. FIG. 10 shows another embodiment of spacer 24. A square or rectangular piece could have merely a slit 54 that leads to one or more cutouts. The dashed lines indicate knock out or punch out cuts 56A, 56B, 56C, and 56D on the piece. The installer would knock out the center to the diameter needed (e.g. 1⅝", 2", 2½", 3"). Spacer 24 could be pulled around the post via the slit 54 and then installed as discussed with regard to FIG. 8.

The included preferred embodiment is given by way of example only, and not by way of limitation to the invention, which is solely described by the claims herein. Variations obvious to one skilled in the art will be included within the invention defined by the claims.

For example, barrier 10 can be made out of a number of materials. Plastics are generally preferred. Examples are PVC, polypropylene and polyethylene. The characteristics needed are set forth above including being able to flex, being able to survive all types of environmental conditions out of doors, and being able to take mowers and people and animals stepping on it. Plastic could be molded to the shape indicated herein.

As previously mentioned, the size and shape can vary. It can be manufactured by a number of methods widely known in the art. An example is injection molding.

The Figures show each section 11 to be two-piece; one piece comprising riser 20 and panel 28 integral with one another; the other piece comprising removable panel 26. Section 11 could be all one piece (riser 20 and panels 26 and 28) or riser 20 could be separate with each panel 26 and 28 removable.

What is claimed is:

1. A blocking member and vegetation barrier apparatus for blocking gap between a fence bottom and the ground and deterring vegetation growth at and near the fence bottom, comprising:

an elongated riser member adapted to be positionable near or along a fence side and extend from at or near the fence bottom and upward;

an elongated ground cover member intersecting with and extending transversely of the riser member to an outer edge which is positioned below an orthogonal plane through the intersection of the ground cover member and the riser, the outer edge comprising a curved piece which is turned under and back to form a ground contacting foot and a receiving channel, the receiving channel being substantially open;

the foot and the remainder of the ground cover member being resilient so that when the foot contacts and is pressed against the ground the substantially open receiving channel allows the ground cover member to be depressed and the ground cover member provides an upward force to the riser member to urge the outer edge of the ground cover member to seat against the ground.

2. The apparatus of claim 1 wherein the elongated riser member comprises a panel having a top edge and a base at or near an opposite edge, and further having opposite ends.

3. The apparatus of claim 2 wherein the top edge includes a bead along its length.

4. The apparatus of claim 2 wherein the ground cover member extends from the base.

5. The apparatus of claim 4 wherein the ground cover member extends in both transverse directions from the base.

6. The apparatus of claim 5 wherein the ground cover member extends in one direction from the base.

7. The apparatus of claim 5 wherein the ground cover member has an outer edge that in a normal position extends lower than the bottom of the riser member.

8. The apparatus of claim 1 wherein the ground cover member is generally orthogonal to the riser member at or near the lower end of the riser member.

9. The apparatus of claim 8 when the ground cover member comprises a first section extending in one direction from the lower end of the riser member to form an L-shape with the riser member.

10. The apparatus of claim 9 further comprising a second section extending in an opposite direction from the first section to form a T-shape with the riser member.

11. The apparatus of claim 1 wherein the securing strap comprises a bungy cord.

12. The apparatus of claim 1 wherein the securing strap comprises a tie down.

13. The apparatus of claim 1 wherein the securing strap comprises wire.

14. The apparatus of claim 1 further comprising a spacer member having edges which are insertable into the receiving channel of ground cover member.

15. A system for blocking a gap between a fence bottom and the ground as well as deterring vegetation growth at or near the fence bottom comprising:

a fence having spaced apart posts and fencing spanning the spaces between posts, the fencing having first and second sides and a bottom edge;

a plurality of substantially flexible, elongated members positioned along the bottom edge of the fencing;

the elongated members comprising a first portion positioned generally against said first side of the fence, and a second portion that extends laterally from the first portion to a distal edge to cover a portion of the ground immediately by the bottom of the fencing, the second portion being flexible and resilient, the distal edge extending to a position below an orthogonal plane through a point of intersection between the first portion and the second portion and being covered and rolled over to form a ground contacting foot and a receiving channel and provide additional spring force, any downward force relative to the the ground contacting foot resulting in a resilient force back against the first portion by the second portion; and spacers interconnected between elongated members.

16. The system of claim 15 wherein the fence is a chain link fence with wire webbing as the fencing.

17. The system of claim 16 wherein the securing members comprise straps.

18. The system of claim 17 wherein the straps are selected from the set comprising tie downs, wire, rope, bungy cords, and belts.

19. The system of claim 15 wherein the fencing is wood.

20. The system of claim 19 wherein the securing members are fasteners.

21. The system of claim 20 wherein the fasteners are selected from the said comprising screws, nails, and bolts.

22. The system of claim 15 wherein the elongated members are several feet long, several inches tall, and several inches wide.

23. The system of claim 15 wherein the first portion has a top and a bottom and comprises a panel with spaced apart openings along its length near its top.

24. The system of claim 15 wherein the second portion extends laterally in one direction.

25. The system of claim 15 wherein the second portion extends laterally in two directions.

26. The apparatus of claim 25 wherein the two directions include one direction on one side of the fencing with the first portion secured thereto and the other direction is under the fencing to the opposite side of the fencing.

27. The apparatus of claim 23 wherein the distal edge is rolled over to form a receiving channel for a spacer.

28. A blocking member and vegetation barrier apparatus for blocking gaps between a fence bottom and the ground and deterring vegetation growth at and near the fence bottom, comprising:

an elongated riser member positionable near or along a fence side and comprising a panel having a top edge and a base at or near an opposite edge, and opposite ends;

a ground cover member extending transversely of the riser member and in one direction from the base, and further comprising a removable section attachable to the base and extending in an opposite direction from the ground cover member; and a plurality of securing members along the riser the securing members comprising apertures at spaced apart positions along the riser member which are configured to receive a securing strap.

29. A blocking member and vegetation barrier apparatus for blocking gaps between a fence bottom and the ground and deterring vegetation growth at and near the fence bottom, comprising:

an elongated riser member positionable near or along a fence side;

a ground cover member extending transversely of the riser member, the ground cover member being generally orthogonal to the riser member at or near the lower end of the riser member and comprising a first section extending in one direction from the lower end of the riser member to form an L-shape with the riser member and a second section extending in an opposite direction from the first section to form a T-shape with the riser member, the second section being detachable from the riser member;

a plurality of securing members along the riser the securing members comprising apertures at spaced apart positions along the riser member which are configured to receive a securing strap.

30. A system for blocking gaps between a fence bottom and the ground as well as deterring vegetation growth at or near the fence bottom comprising:

a fence having spaced apart posts and fencing spanning the spaces between posts, the fencing having first and second sides and a bottom edge;

a plurality of substantially flexible, elongated members positioned along the bottom edge of the fencing;

elongated members comprising a first portion positioned generally against said first side of the fence, and a second portion that extends laterally from the first portion to cover a portion of the ground immediately by the bottom of the fencing, the second portion extending laterally in two directions and being detachable;

each elongated member secured to the fencing by securing members which extend through the first portion and retain the first portion against any substantial vertical movement relative to the fencing so that the second portion can be placed in variable position relative to the fencing and the ground and secured vertically; and spacers interconnected between elongated members.

31. A blocking member and vegetation barrier apparatus for blocking gap between a fence bottom and the ground and deterring vegetation growth at and near the fence bottom, comprising:

an elongated riser member positionable near or along a fence side, the elongated riser member comprising a panel having a top edge and a base at or near an opposite edge, and further having opposite ends, and the base is a thickened portion;

a ground cover member extending transversely of the riser member and comprising an outer edge which extends below an orthogonal plane through the intersection of the ground cover member and the riser and which is turned under and back to form a receiving channel, the receiving channel being substantially open;

the ground cover member being resilient so that when pressed against the ground it provides an upward force to the riser member.

32. The apparatus of claim 29 wherein the second section is detachable by a releasable connection between the second section and the riser member.

* * * * *